US009969953B2

(12) United States Patent
Chery

(10) Patent No.: US 9,969,953 B2
(45) Date of Patent: May 15, 2018

(54) FRAGRANCE COMPOSITION

(71) Applicant: Marcelle Chery, Plantation, FL (US)

(72) Inventor: Marcelle Chery, Plantation, FL (US)

( * ) Notice: Subject to any disclaimer, the term of this patent is extended or adjusted under 35 U.S.C. 154(b) by 0 days. days.

(21) Appl. No.: 14/826,559

(22) Filed: Aug. 14, 2015

(65) Prior Publication Data

US 2017/0298289 A1 Oct. 19, 2017

(51) Int. Cl.
*C11B 9/00* (2006.01)

(52) U.S. Cl.
CPC ..... *C11B 9/00* (2013.01)

(58) Field of Classification Search
CPC ..... C11B 9/00
USPC ..... 512/5
See application file for complete search history.

(56) References Cited

U.S. PATENT DOCUMENTS

2008/0131858 A1* 6/2008 Gordon ..... G09B 19/0076
434/327
2009/0176690 A1* 7/2009 Laudamiel ..... A61K 8/585
512/2

* cited by examiner

*Primary Examiner* — Jessica Whiteley
(74) *Attorney, Agent, or Firm* — RG Patent & Consulting, LLC; Rachel Gilboy

(57) ABSTRACT

The present invention provides a fragrance composition for use in toilet preparations. The fragrance compositions consist of blend of essential oils from flowers and other parts of plants including sandalwood, jasmine, rose, magnolia blossom, frangipani, gardenia, cedar, mandarin, amber, almond, ylang-ylang, vanilla, patchouli, orange, birch wood, oak moss, patchouli; and also include suitable amount of musk. The invention is commercially advantageous by providing a method to produce natural oil based fragrance composition at comparatively low cost.

12 Claims, 1 Drawing Sheet

FRAGRANCE COMPOSITION

CROSS REFERENCE TO RELATED APPLICATIONS

Not applicable.

FEDERALLY SPONSORED RESEARCH AND DEVELOPMENT

Not applicable.

MICROFICHE

Not applicable

BACKGROUND OF THE INVENTION

(1) Field of the Invention

The present invention relates to fragrance composition, more particularly, the invention relates to a composition comprising blend of essential oils.

(2) Background

Use of perfumes or fragrances is known from ancient times and people have been applying fragrances for various reasons such as aesthetic or cultural. The word perfume is of Latin origin wherein the phrase "per" means through and "fumus" means smoke. In French it is also known as "Parfum" that connotes a pleasant smell that comes from burning the incense, which was the first form of perfume. Some earlier methods of making perfume include maceration and extraction. Such methods are still used to extract essential oils from parts of plants such as flowers or animal parts. The essential oils have unique fragrance which is their characteristic and defined as a particular region of note, such as flowery or woodsy.

Typically a blend of perfumes is used to produce characteristic smells to please the senses. From the far reaching range of individual perfumes, many combinations are possible, particularly those which are liked by most people. There have been continuous attempts to produce a new and better perfume, and include exploring new natural sources as well use of synthetic compounds with a particular essence. Moreover attempts have been made to decrease the cost of perfume by using synthetic substances that resemble notes of natural essential oil. However the use of synthetic substances poses risk of side effects including skin allergies.

A typical perfume comprises a mixture of essential oil in alcohol and water. The concentration of essential oils determines the cost of product and is variable. Depending upon the concentration, the perfume may last for few to several hours. Many attempts have been made do device formulations of perfume that are convenient to use and do not leave any mark on clothes or skin. Moreover attempts have been made to decrease the amount of alcohol which sometimes produces skin irritation such as dryness. Eau de cologne is a similar kind of formulation which is preferably used by males and contains 3-8% of aromatic substance. Eau de toilette is similar kind of formulation which contains little more amounts of essential oils or aromatic substances and is costlier. Eau de perfume contains more amount of perfume that Eau de toilette and applied in small amount. Perfume is concentrated fragrances and contains about 40-50% of essential oils. Usually a single drop of oil is applied and is mainly used in composition of other formulations.

Despite, several types of perfumes and other formulations available in the market, there is a continuous need for new perfume compositions with characteristic aromas and which is cost effective.

BRIEF SUMMARY OF THE INVENTION

The present invention, therefore, has as its principal objective to provide a fragrance composition comprising of a blend of natural oils.

Another objective of the invention is to provide a fragrance composition for use in toilet preparations, such as perfumes, Eau de cologne, Eau de toilette, Eau de perfume, solutions, gels, creams, ointments, foams, emulsions, micro-emulsions, milks, serums, aerosols, sprays, dispersions, micro-capsules and micro-particles, etc.

Yet another objective of the current invention is to provide a fragrance composition that is economic and does not contain harmful chemicals.

Certain embodiments of current invention provide a fragrance composition consisting of a blend of essential oils from flowers and other parts of plants, including sandalwood, jasmine, rose, *magnolia* blossom, frangipani, *gardenia*, cedar, mandarin, amber, almond, ylang-ylang, vanilla, patchouli, orange, birch wood, oak moss, and patchouli.

According to another embodiment of the current invention, the fragrance composition consists of the essential oils of sandalwood, jasmine, rose, *magnolia* blossom, frangipani, musk, and *gardenia*.

According to another embodiment of the current invention, the fragrance composition consists of the essential oils of cedar, mandarin, amber, and dark musk.

According to another embodiment of the current invention, the fragrance composition consists of the essential oils of sandalwood, amber, jasmine, rose, ylang-ylang, vanilla, and patchouli.

According to another embodiment of the current invention, the fragrance composition consists of the essential oils of orange, cedar, birch wood, oak moss, amber, patchouli, light musk, and incense.

According to another embodiment of the current invention, the fragrance compositions also include altered concentrations of musk corresponding to light or dark musk.

The summary is provided to introduce a selection of concepts, in a simplified form, that are further described below in the detailed description. This summary is not intended to identify key features or essential features of the subject matter, nor is it intended to be used as an aid in determining the scope of the subject matter. In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. Also, it is to be understood that the phraseology and terminology employed herein are for the purpose of description, and should not be regarded as limiting. These, together with other objectives of the invention and the various features of novelty that characterize the invention, are pointed out with particularity in the disclosure. For a better understanding of the invention, its operating advantages, and the specific objectives attained by its uses, reference should be had to the accompanying drawings and descriptive matter, in which there are illustrated preferred embodiments of the invention.

BRIEF DESCRIPTION OF THE DRAWINGS

The drawings constitute a part of this specification, and include exemplary embodiments to the invention, which may be embodied in various forms. It is to be understood that, in some instances, various aspects of the invention may be shown exaggerated or enlarged to facilitate an understanding of the invention.

DETAILED DESCRIPTIONS OF THE INVENTION

Figures 1, 2, 3, 4, 5, 6, 7:
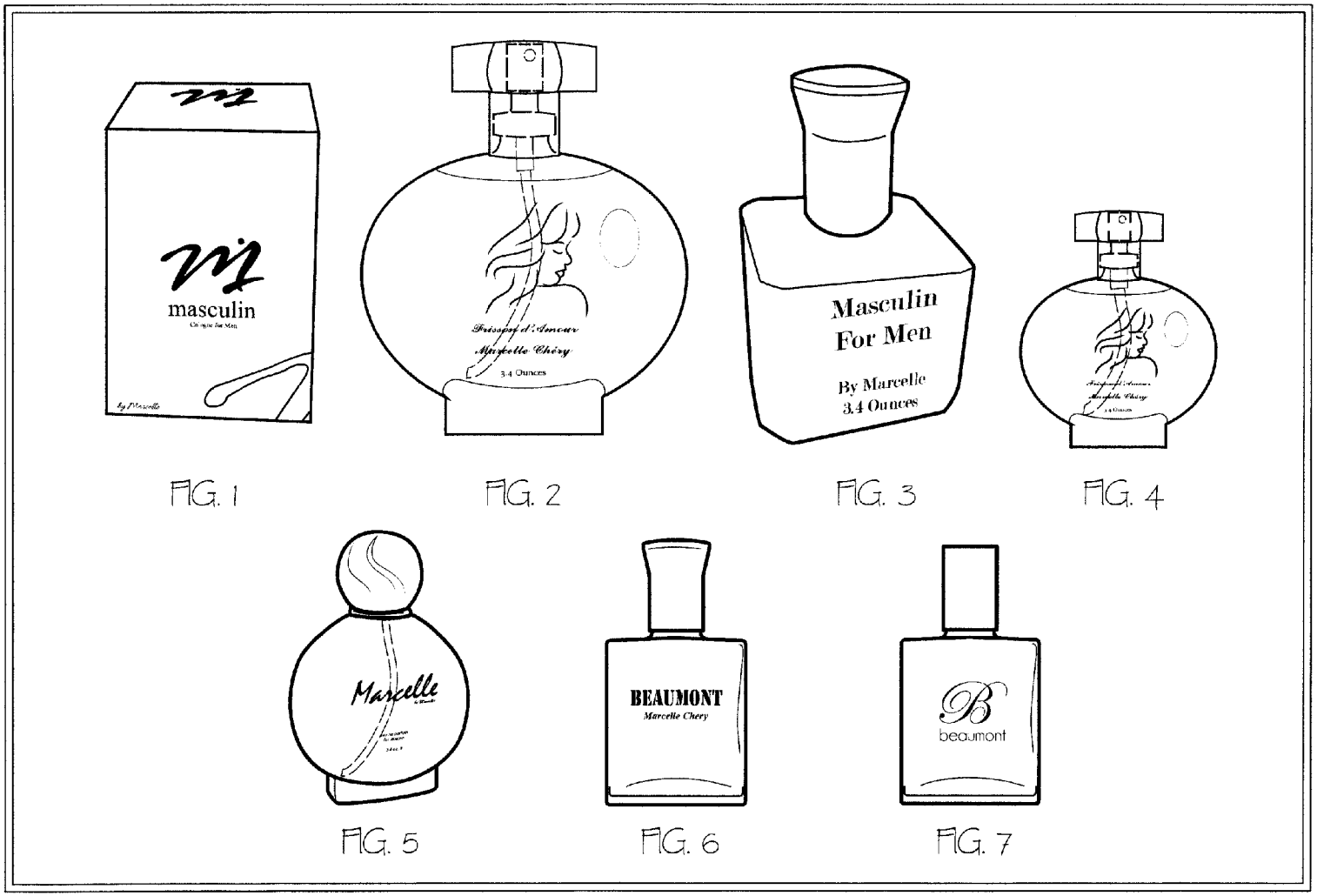
FIG. 1: shows front and top side view of the perfume package.
FIG. 2: shows the front view of the perfume bottle with cap.
FIG. 3: shows the front view of another perfume bottle with cap.
FIG. 4: shows the front view of yet another perfume bottle with cap.
FIG. 5: shows the front view of yet another perfume bottle with cap.
FIG. 6: shows the front view of yet another perfume bottle with cap.
FIG. 7: shows the front view of yet another perfume bottle with cap.

The following is a detailed description of example embodiments of the invention that is depicted in the accompanying drawings. The example embodiments are in such detail as to clearly communicate the invention. However, the amount of detail offered is not intended to limit the anticipated variations of embodiments. On the contrary, the intention is to cover all modifications, equivalents, and alternatives falling within the spirit and scope of the present invention. The detailed descriptions below are designed to make such embodiments obvious to a person of ordinary skill in the art.

The present invention provides a fragrance composition that comprises essential oils derived from natural sources such as flowers and other parts of plants, animals or parts of animals etc. Depending upon the source, the oil has its own unique essence or notes, and large number of such essential oils is available. Two or more such oils can be combined to produce compositions that have broader and mix range of notes. The present invention includes essential oils from flowers and other parts of plants of sandalwood, jasmine, rose, magnolia blossom, frangipani, gardenia, cedar, mandarin, amber, almond, ylang-ylang, vanilla, patchouli, orange, birch wood, oak moss, and patchouli. The composition comprises natural substances and does not contain any substance that irritates the skin.

In one preferred embodiment the fragrance composition consist of essential oils of sandalwood, jasmine, rose, magnolia blossom, frangipani and gardenia. The composition further comprises suitable amount of musk. The composition could be used in the formulation of perfumes, preferably for women. The unique blend of essential oils produces a fragrance with notes in the region of floral with shivering sweetness that is reminiscent of an afternoon sipping a Rhum Barbancourt.

In another preferred embodiment the fragrance composition consist of essential oils from cedar, mandarin, amber and almond. The composition further includes dark musk and is preferably used as cologne for men. The blend of said essential oils produces a more masculine scent. The scent appears fresh and has notes in the region of classic and woody with an aphrodisiac trace.

In another preferred embodiment the fragrance composition consist of essential oils from sandalwood, amber, jasmine, rose, ylang-ylang, vanilla, amber and patchouli and further includes musk. The said composition could preferably be used in ladies perfume. The perfume has notes of classic fragrances, appears as luxurious and sensual.

In another preferred embodiment, the fragrance composition consist of essential oils from orange, cedar, birch wood, oak moss, amber, patchouli and further includes incense and light musk. The amount of musk is relatively higher to make it preferable for men. The composition could be formulated as cologne and bears notes in the range of woodsy and masculine with a touch of fruit.

The quantities of components in composition are such that it produces a nice soft smell that is liked by most people. Preferably the composition is used as perfumes, colognes etc. The fragrances are made from essential oils without any added chemicals and preservatives. However fragrance compositions could also be used in other formulations such as soaps, body wash, body lotion and other toilet preparation. The perfume is preferably in liquid forms and contains alcohol in a very small quantity and other ingredients to make a suitable formulation that could be used as a mist. The perfumes could be provided in spray bottles for convenient use. For safety a crimp is provided on sprayer with every bottle of fragrance, instead of a twist. Preferably bottles with aesthetically pleasing designs are used and placed into the box FIG. 1. FIG. 2-7 shows such kind of bottles. Beside the perfume, the composition could also be available in other formulation such as roll-on sticks etc.

The amount of fragrance is such that the perfume produces a long lasting effect and the formulations and packaging is chosen such that the overall cost of the product is low. Moreover the composition does not leave any mark on skin or clothes. Thus the perfume would be economic thus making it popular within reach of common people.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

I claim:

1. A fragrance composition comprised essential oils, alcohol, and water wherein essential oils consist of the oils extracted from sandalwood, jasmine, rose, magnolia blossom frangipani, gardenia, and musk.

2. A fragrance composition according to claim 1, wherein said composition consists of water up to 10%, alcohol up to 70%, and essential oils up to 20%.

3. A fragrance composition comprised essential oils, alcohol and water wherein the essential oils consist of oils extracted from cedar, mandarin, almond, amber and dark musk.

4. A fragrance composition according to claim 3, wherein said composition consists of water up to 10%, alcohol up to 70%, and essential oils up to 20%.

5. A fragrance composition comprising essential oils, alcohol, and water wherein essential oils consist of oils extracted from sandalwood, amber, jasmine, rose, ylang-ylang, vanilla, patchouli, and musk.

6. A fragrance composition according to claim 5, wherein said composition consists of water up to 10%, alcohol up to 70%, and essential oils up to 20%.

7. A fragrance composition comprised of essential oils, alcohol, and water wherein essential oils consisting of oils extracted from orange, cedar, birch wood, oak moss, light musk, and incense.

8. A fragrance composition according to claim 7, wherein said composition consists of water up to 10%, alcohol up to 70%, and essential oils up to 20%.

9. A fragrance composition according to claim 1, wherein said fragrance composition can be applied as Eau de cologne, Eau de toilette, Eau de perfume solutions, gels, creams, ointments, foams, emulsions, micro-emulsions, milks, serums, aerosols, sprays, dispersions, micro-capsules and micro-particles thereof.

10. A fragrance composition according to claim 3, wherein said fragrance composition can be applied as Eau de cologne, Eau de toilette, Eau de perfume, solutions, gels, creams, ointments, foams, emulsions, micro-emulsions, milks, serums, aerosols, sprays, dispersions, micro-capsules and micro-particles thereof.

11. A fragrance composition according to claim 5, wherein said fragrance composition can be applied as Eau de cologne, Eau de toilette, Eau de perfume, solutions, gels, creams, ointments, foams, emulsions, micro-emulsions, milks, serums, aerosols, sprays, dispersions, micro-capsules and micro-particles thereof.

12. A fragrance composition according to claim 7, wherein said fragrance composition can be applied as Eau de cologne, Eau de toilette, Eau de perfume, solutions, gels, creams, ointments, foams, emulsions, micro-emulsions, milks, serums, aerosols, sprays, dispersions, micro-capsules and micro-particles thereof.

* * * * *